US008181432B2

(12) United States Patent
Bonneville et al.

(10) Patent No.: US 8,181,432 B2
(45) Date of Patent: May 22, 2012

(54) WEB PACKAGING SYSTEM WITH ERGONOMIC FORMING PLUG CHANGE

(75) Inventors: Craig R. Bonneville, Black Earth, WI (US); Daryl W. Shackelford, Waunakee, WI (US)

(73) Assignee: Alkar-RapidPak-MP Equipment, Inc., Lodi, WI (US)

( * ) Notice: Subject to any disclaimer, the term of this patent is extended or adjusted under 35 U.S.C. 154(b) by 134 days.

(21) Appl. No.: 12/729,991

(22) Filed: Mar. 23, 2010

(65) Prior Publication Data

US 2010/0175350 A1 Jul. 15, 2010

Related U.S. Application Data

(62) Division of application No. 11/876,858, filed on Oct. 23, 2007, now Pat. No. 7,703,265.

(51) Int. Cl.
*B65B 47/00* (2006.01)

(52) U.S. Cl. ..... 53/453; 53/454; 53/559; 493/143

(58) Field of Classification Search ..... 53/453, 53/454, 559, 561, 560; 493/143, 144, 142, 493/145; 425/143, 144, 142, 145, 186, 383
See application file for complete search history.

(56) References Cited

U.S. PATENT DOCUMENTS

| | | | |
|---|---|---|---|
| 3,230,869 | A | 1/1966 | Wilkins |
| 3,808,772 | A | 5/1974 | Turtschan |
| 4,370,112 | A | 1/1983 | Sorbier |
| 4,449,907 | A | 5/1984 | Yonezawa et al. |
| 4,529,371 | A | 7/1985 | Nickley |
| 4,773,839 | A | 9/1988 | Case et al. |
| 4,894,977 | A | 1/1990 | Rittinger et al. |
| 4,897,985 | A | 2/1990 | Buchko et al. |
| 4,987,725 | A | 1/1991 | Gill |
| 5,014,500 | A | 5/1991 | Robache |
| 5,170,611 | A | 12/1992 | Buchko et al. |
| 5,205,110 | A | 4/1993 | Buchko |
| 5,307,610 | A | 5/1994 | Schneider et al. |
| 5,443,150 | A | 8/1995 | Buchko |
| 5,682,729 | A | 11/1997 | Buchko |
| 5,785,270 | A | 7/1998 | Buchko |
| 5,813,197 | A | 9/1998 | Aguzzoli |
| 6,085,490 | A | 7/2000 | Buchko |
| 6,240,706 | B1 | 6/2001 | Thomas et al. |
| 6,843,043 | B2 | 1/2005 | Hanson et al. |
| 6,941,729 | B2 | 9/2005 | Dal Pozzo |
| 7,055,296 | B2 | 6/2006 | Christ |
| 7,121,063 | B2 | 10/2006 | Haws |
| 7,340,871 | B1 | 3/2008 | Shackelford et al. |
| 7,607,279 | B2 | 10/2009 | Shackelford et al. |

FOREIGN PATENT DOCUMENTS

| | | | |
|---|---|---|---|
| EP | 0 467 069 | A1 | 1/1992 |

OTHER PUBLICATIONS

Brochure entitled "Low-Profile Plug Assist", Alkar-RapidPak, Inc., Apr. 2007.

European Search Report mailed Feb. 23, 2009 in counterpart European Patent Application No. 08018448.4.

*Primary Examiner* — Sameh H. Tawfik

(74) *Attorney, Agent, or Firm* — Andrus, Sceales, Starke & Sawall, LLP

(57) ABSTRACT

A web packaging system provides easy access and changing of forming plug tooling.

7 Claims, 13 Drawing Sheets

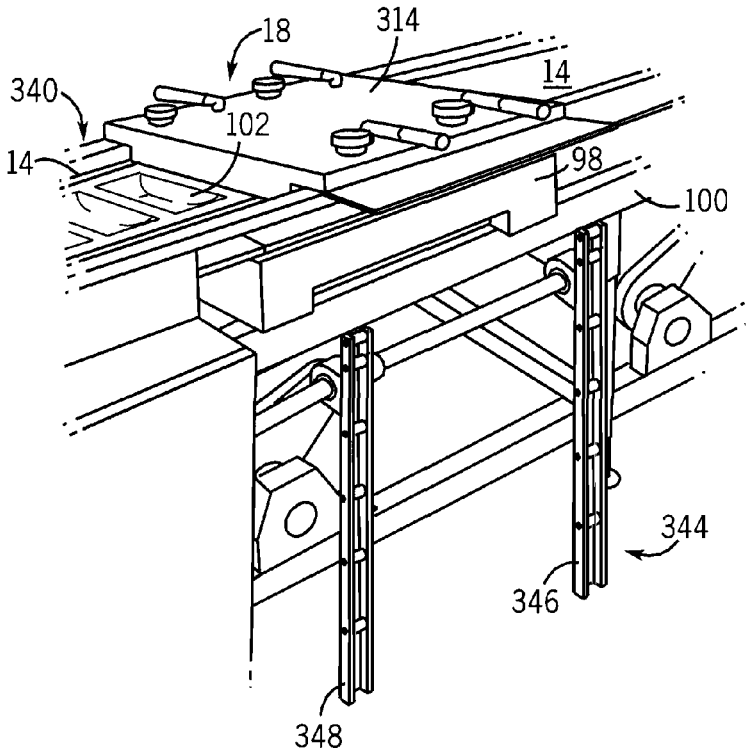
FIG. 14
FIG. 15
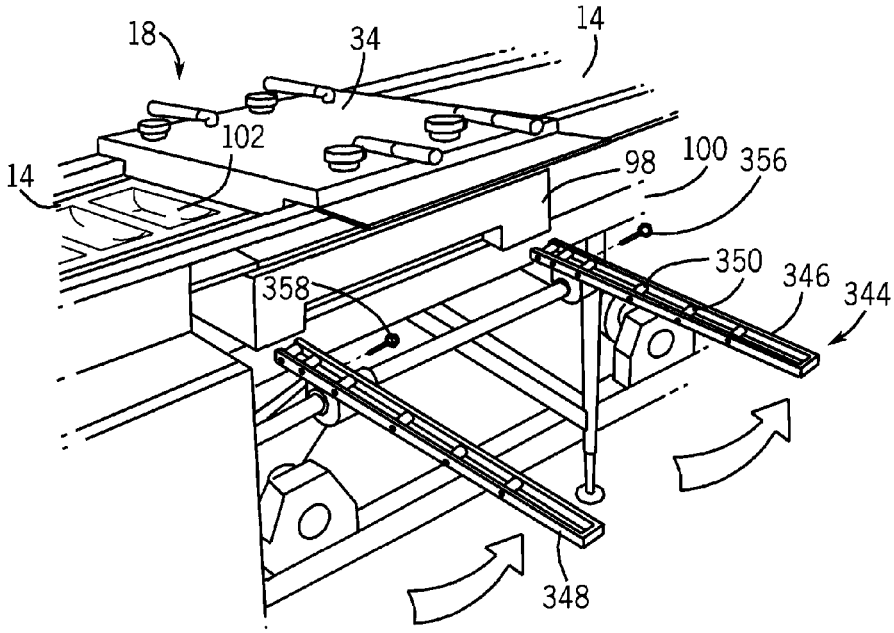

WEB PACKAGING SYSTEM WITH ERGONOMIC FORMING PLUG CHANGE

CROSS-REFERENCE TO RELATED APPLICATION

This application is a division of co-pending U.S. patent application Ser. No. 11/876,858, filed Oct. 23, 2007, which application is incorporated herein by reference.

BACKGROUND

The invention relates to web packaging apparatus and methods for packaging a product between upper and lower webs.

Web packaging systems are known in the prior art, for example U.S. Pat. Nos. 5,170,611, 5,205,110, incorporated herein by reference. A web transport conveyor transports a lower web from upstream to downstream through a series of stations receiving a product in a lower web package at a loading station, and closing the package with the upper web at a closing station. A forming station upstream of the loading station forms a downwardly dependent product cavity pocket in the lower web into which the product is loaded. The forming station has a forming tooling die box supported on a base plate moveable between a first upper position in which the forming tooling die box engages the lower web and forms the lower web into the product cavity pocket, and a second lower position in which the forming tooling die box is moved downwardly away from the lower web, to enable advancement of the lower web and product cavity pocket downstream to the loading station. The die box is removed from the base plate to enable tooling change, e.g. a change to a different die box or placement of different shaped inserts into the die box to provide a different shaped product cavity pocket, or placement of filler plates or the like in the bottom of the die box chambers to provide different height product cavity pockets, etc.

Commonly owned U.S. patent application Ser. No. 11/395,932, filed Mar. 31, 2006, now U.S. Pat. No. 7,340,871, incorporated herein by reference, arose during continuing development efforts directed toward simplified tooling change. The '932 system provides simplified, user-friendly, ergonomic tooling change.

The present invention arose during further continuing development efforts directed toward simplified tooling change, including a plug assist mechanism when used to assist formation of the product cavity pocket into the noted forming tooling die box.

BRIEF DESCRIPTION OF THE DRAWINGS

FIG. 1 is an isometric view of a packaging machine constructed in accordance with the '611 patent.

FIG. 2 is a side elevation view of the packaging machine of FIG. 1, with guards and covers removed to expose the components of the machine.

FIG. 3 is a schematic side view showing the web unwinding mechanism for supplying the lower web of packaging material.

FIG. 4 is a schematic view showing the steps involved in deforming the flexible web of packaging material at the forming station to provide a product cavity adapted to receive product to be packaged.

FIG. 5 is an enlarged partial side view showing the forming tooling, in its raised position.

FIG. 6 is a partial transverse sectional view illustrating the plug assist mechanism of the '611 patent.

FIG. 7 is a partial transverse sectional view showing a cutting assembly for transversely cutting the formed packages.

FIG. 8 is a schematic block diagram of control screen selections for controlling operation of the packaging machine.

FIG. 9 is a schematic block diagram of the control and drive arrangement for the servo motors.

FIGS. 10-17 are taken from above noted incorporated U.S. patent application Ser. No. 11/395,932.

FIG. 10 is an isometric view of a portion of the system of FIG. 1.

FIG. 11 is like FIG. 10 and illustrates a sequential step in tooling change.

FIG. 12 is like FIG. 11 and shows a further sequence step.

FIG. 13 is like FIG. 12 and shows a further sequence step.

FIG. 14 is like FIG. 10 but shows the system of the '932 application.

FIG. 15 is like FIG. 14 and shows a further sequence step for tooling change.

FIG. 16 is like FIG. 15 and shows a further sequence step.

FIG. 17 is an enlarged view of a portion of FIG. 14 and shows a further sequence step.

DETAILED DESCRIPTION

The following description of FIGS. 1-9 is taken from incorporated U.S. Pat. No. 5,170,611.

Figure 1:
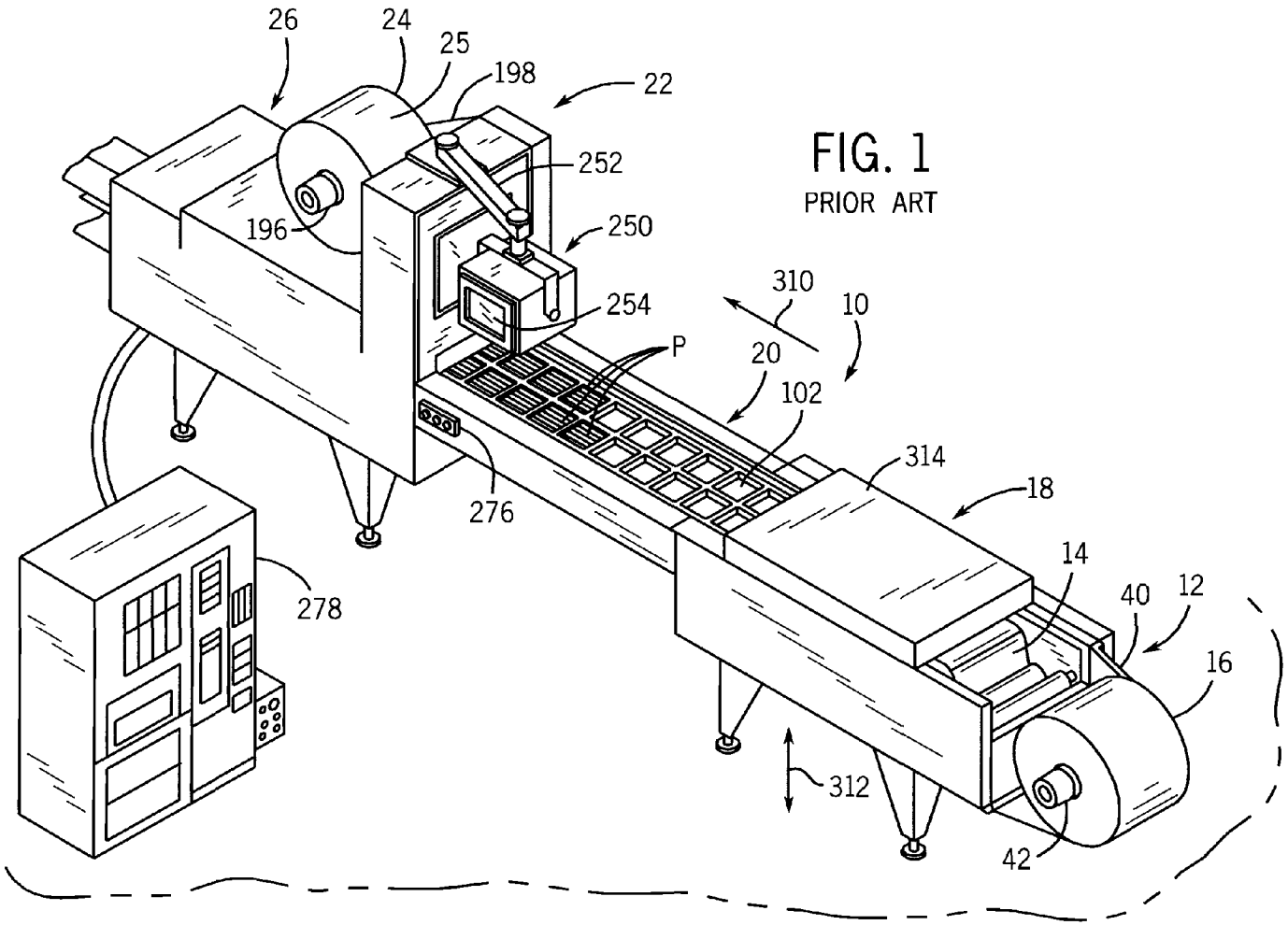
FIG. 1 PRIOR ART
FIGS. 1-9 are taken from above noted incorporated U.S. Pat. No. 5,170,611 and U.S. patent application Ser. No. 11/395,932.
Figure 2:
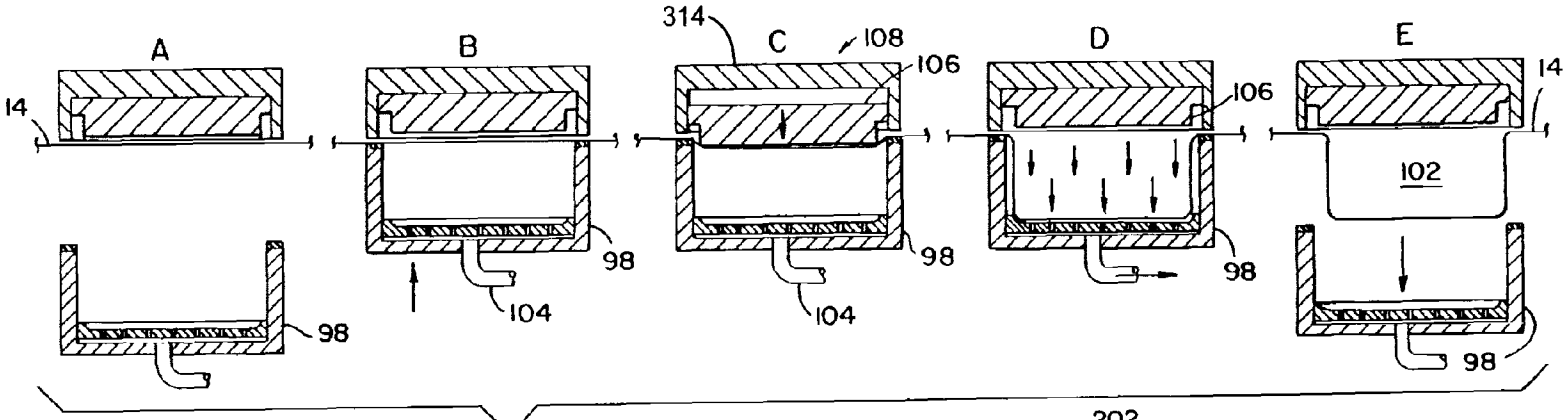
FIG. 2 PRIOR ART

FIGS. 1 and 2 illustrate a packaging machine 10. Packaging machine 10 generally includes a lower web supply station 12 for supplying a lower web 14 of flexible packaging material from a supply roll 16, a forming station 18, a loading station 20, an upper web supply station 22 for supplying an upper web of flexible packaging material from a supply roll 24, and a downstream station shown generally at 26. The operations performed at downstream station 26 will later be explained.

The various components of packaging machine 10 are mounted to and supported by a frame assembly (FIG. 2) including a pair of spaced parallel upper frame members 28, lower spaced frame members such as shown at 30, 32, and 34, and a series of vertical frame members extending between upper frame member 28 and lower frame members 30, 32 and 34. A series of legs 36 are provided for supporting machine 10 above a floor 38.

Figure 3:
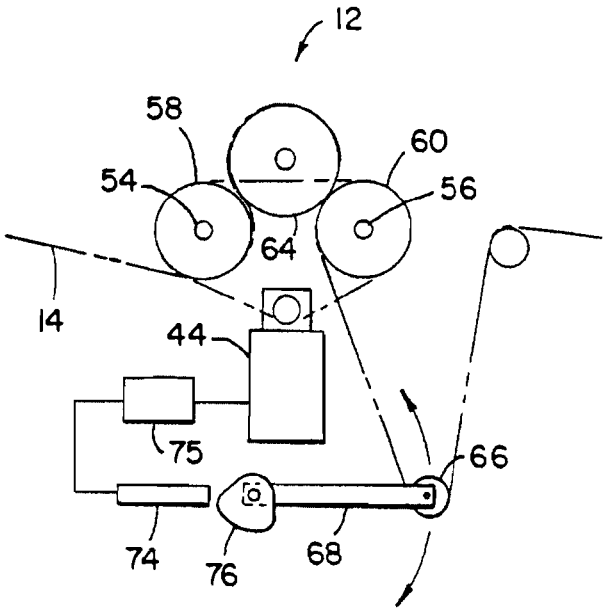
FIG. 3 PRIOR ART

Lower web supply station 12 includes a roll support bracket 40 and an unwind shaft 42 extending from bracket 40. Supply roll 16 is rotatably mounted to shaft 42, which is stationarily mounted to bracket 40. An unwind motor 44 (FIG. 2) is mounted to a plate 46, and has its output shaft engaged with a gear box 48 which includes a horizontally oriented output shaft driven in response to rotation of the output shaft of motor 44. A pair of timing pulleys 50, 52 are fixed to a pair of shafts 54, 56, respectively, which extend through plate 46 and are fixed to a pair of driven steel rollers 58, 60 (FIG. 3). A timing belt 62 is trained around timing pulleys 50, 52 and a timing pulley (not shown) engaged with the horizontal output shaft of gear box 48.

Referring to FIG. 3, a rubber surfaced nip roller 64 rests on top of driven rollers 58 and 60, forming a pair of nips between roller 64 and rollers 58, 60. Lower web 14 is fed below driven roller 58, up and over nip roller 64, and below driven roller 60. Upon operation of motor 44, drive rollers 58 and 60 are driven in response to rotation of timing pulleys 50, 52, and lower web 14 is unwound from supply roll 16 by rotation of driven rollers 58, 60 and nip roller 64.

Motor 44 is a conventional variable speed DC motor, which provides variable speed unwinding of lower web 14 from supply roll 16 during its operation.

From driven roller 60, lower web 14 is trained around a dancer roller 66 rotatably mounted to a dancer arm 68, which is pivotably supported at its upper end on a shaft 70 extending between the sides of the machine frame. As noted previously, and as will be explained in greater detail, web 14 is advanced through machine 10 in an indexing fashion. The dancer assembly, consisting of dancer arm 68 and dancer roller 66, acts as an actuator for switching unwind motor 44 on and off and for controlling its speed of operation, for providing unwinding of lower web 14 from supply roll 16 in response to indexing movement of lower web 14 through the stations downstream of the dancer assembly.

As noted previously, unwind motor 44 is a variable speed motor. Motor 44 is responsive to the position of dancer arm 68 which increases or decreases the motor speed as required to accommodate the indexing advancement of lower web 14 downstream of the dancer assembly. Motor 44 is normally off, and the dancer assembly selectively actuates motor 44 and controls its speed of operation.

Referring to FIGS. 2 and 3, transducer-type proximity switch 74 is mounted to plate 46, and is interconnected with unwind motor 44 through a motor drive 75. A cam-shaped switch actuator member 76 is mounted to dancer arm 68, for selectively actuating proximity switch 74.

Actuator member 76 provides a cam-shaped actuator surface, which acts on proximity switch 74 to control the speed of operation of motor 44. As noted previously, motor 44 is normally off. The cam shape of actuator member 76 provides gradual switching of motor 44 between its "on" and "off" modes.

When lower web 14 is pulled by the indexing drive mechanism, as will be explained, dancer arm 68 pivots counter-clockwise so as to bring actuator member 76 into proximity with switch 74. Proximity switch 74 then causes motor 44 to operate, first at a low speed and then at a higher speed as dancer arm 68 further pivots counter-clockwise, until motor 44 is operating at full speed, to unwind lower web 14 from supply roll 16. As the supply of lower web 14 from supply roll 16 catches up with the indexing advancement of lower web 14, dancer arm 68 pivots about shaft 70 in a clockwise direction. Actuator member 76 then causes proximity switch 74 to slow the speed of operation of motor 44. When the indexing advancement of lower web 14 ceases, motor 44 continues to supply lower web 14 to dancer roller 66 and dancer arm 68 is pivoted clockwise until actuator member 76 is moved an amount sufficient to cut off power to motor 44 through proximity switch 74.

Dancer arm 68 thus moves in an arcuate back and forth manner as long as actuator member 76 is maintained in proximity to proximity switch 74 during indexing advancement of web 14 downstream of the dancer assembly continues.

To advance lower web 14, a servo motor 78 is mounted to lower frame members 34, and includes an output shaft to which a timing pulley 80 is mounted. A timing belt 82 is trained around timing pulley 80, and also around a driven timing pulley 84 mounted to a driven shaft 86. Driven shaft 86 is rotatably supported between the sides of the frame of packaging machine 10.

Figure 6:
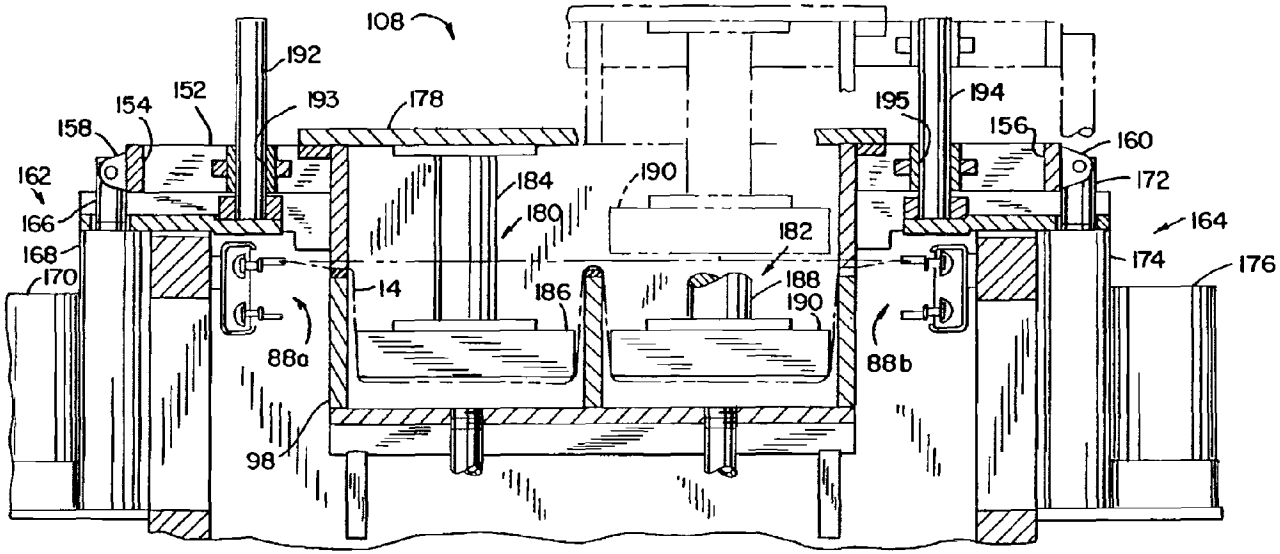
FIG. 6 PRIOR ART
Figure 7:
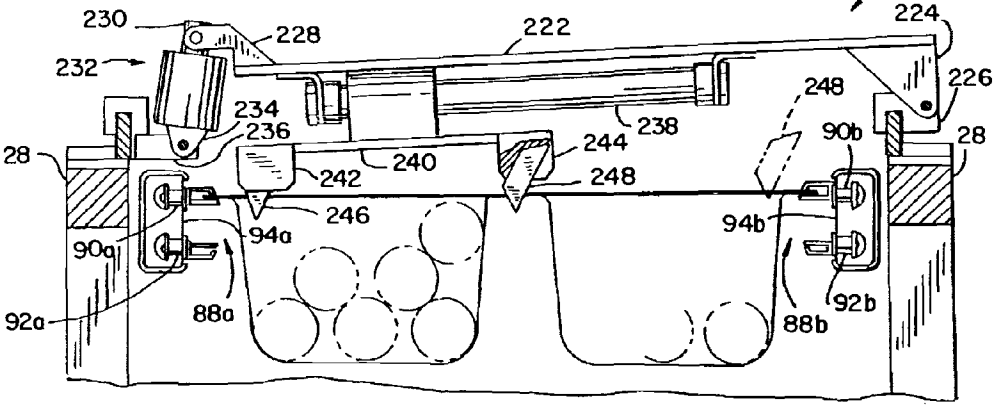
FIG. 7 PRIOR ART

Referring briefly to FIGS. 6 and 7, a pair of gripper chains shown generally at 88*a* and 88*b*, are provided on either side of the frame of packaging machine 10. Gripper chains 88*a* and 88*b* provide upper runs 90*a* and 90*b*, respectively, and lower runs 92*a* and 92*b*, respectively. The upper and lower runs of chains 88*a*, 88*b* are mounted in inwardly facing slots formed in facing blocks 94*a*, 94*b*, located on either side of the frame of packaging machine 10. Blocks 94*a* 94*b* are mounted to upper frame members 28, and provide sliding movement of gripper chains 88*a*, 88*b* along the length of packaging machine 10. Blocks 94*a*, 94*b* are formed of an ultra-high molecular weight polyethylene material.

Gripper chains 88*a*, 88*b* may be such as manufactured by Curwood, Inc. of Oshkosh, Wis. under its U.S. Pat. No. 4,915,283. This arrangement provides gripping of lower web 14 along its edges at upper runs 90*a*, 90*b*, of gripper chains 88*a*, 88*b*.

Driven shaft 86 (FIG. 2), which is rotatable in response to rotation of the output shaft of indexing drive servo motor 78, has a pair of chain drive sprockets (not shown) connected thereto for engagement with gripper chains 88*a*, 88*b*. In this manner, intermittent operation of servo motor 78 provides indexing movement of gripper chains 88*a*, 88*b*, to indexingly advance lower web 14 through packaging machine 10.

Lower web 14 is gripped between upper runs 90*a*, 90*b* of gripper chains 88*a*, 88*b* downstream of the dancer assembly and upstream of forming station 18, and is thereafter supplied to forming station 18 in an indexing fashion.

A web heater apparatus, shown generally at 96, is located immediately upstream of forming station 18 for heating lower web 14 prior to forming of web 14 at forming station 18. The preheating of web 14 imparts increased flexibility to web 14 to assist in deforming web 14 at forming station 18.

Forming tooling is provided at forming station 18 below web 14. As shown in FIG. 2, the forming tooling comprises a chilled forming box 98 mounted to a frame assembly 100. As will be explained, forming box 98 is movable between a raised position and a lowered position. In its raised position, forming box 98 acts on lower web 14 to deform web 14 downwardly to form a product cavity, and in its lowered position is moved away from web 14 so as to allow advancement of web 14 with the product cavity formed therein.

Figure 4:
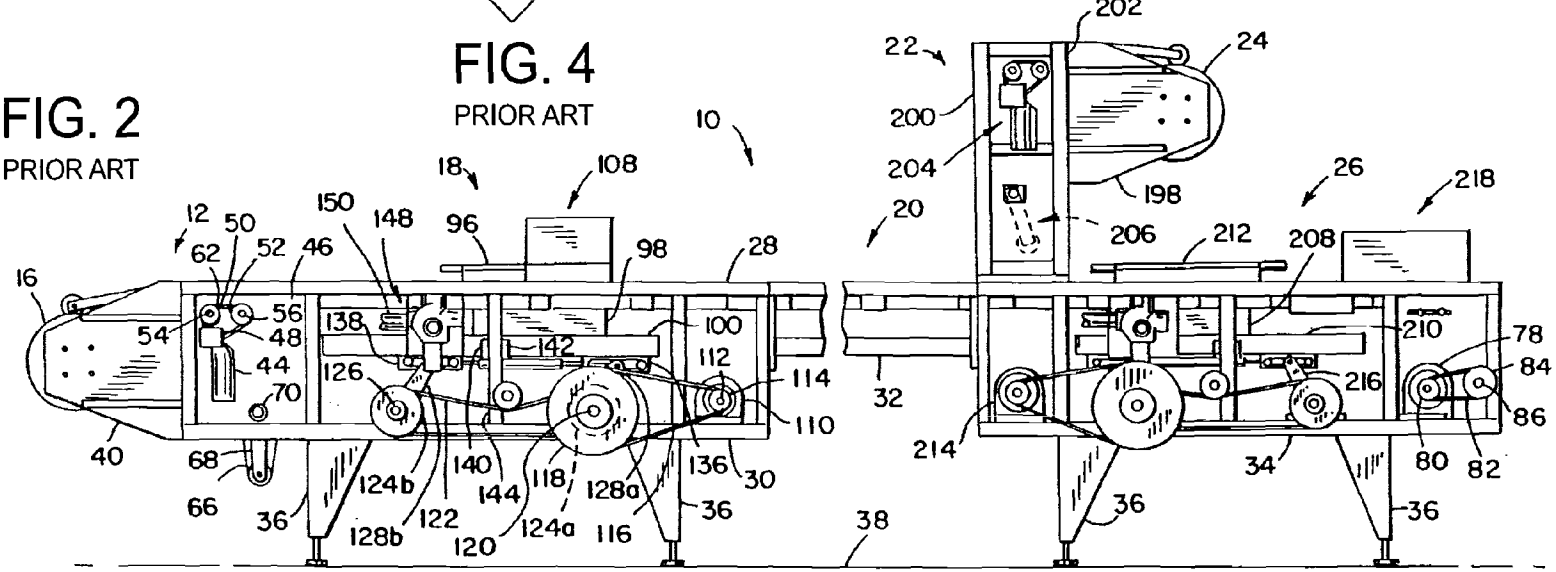
FIG. 4 PRIOR ART

FIG. 4 illustrates the series of steps which take place at forming station 18 in order to form a product cavity 102 in lower web 14. The forming arrangement shown in FIG. 4 is preferably employed when forming a relatively shallow product cavity 102 in lower web 14. At position A, forming box 98 is in its lowered position, and an undeformed portion of web 14 is located over the open upper end of forming box 98. While web 14 is maintained stationary, forming box 98 is moved upwardly to position B, where the upper ends of the side walls of forming box 98 come into contact with the underside of web 14. Negative air pressure is then supplied to the interior of forming box 98 through a vacuum line 104 and a series of air passages formed in the bottom of forming box 98. At position C, a plug member 106 associated with a plug assist mechanism 108 moves downwardly under the influence of air pressure so as to come into contact with the upper surface of lower web 14, and to assist web 14 in deforming into the interior of forming box 98. At position D, plug member 106 is retracted to its upper position, and the negative air pressure supplied by vacuum line 104 deforms lower web 14 downwardly into the interior of forming box 98 until the lower surface of web 14 is disposed against the bottom and sides of the interior of forming box 98. Product cavity 102 is thus formed. At position E, forming box 98 is moved downwardly an amount sufficient to allow formed web 14 to advance downstream from forming station 18, whereafter the described sequence of steps is repeated to again form another product cavity 102 in the upstream portion of lower web 14. The previously formed product cavity 102 is advanced to loading station 20, where product to be packaged is placed into product cavity 102.

Referring to FIG. 2, a servo lift motor 110 is mounted to lower frame members 30, and includes an output shaft 112 to which a drive timing pulley 114 is mounted. A timing belt 116 is trained around drive pulley 114 and a large driven pulley 118, which is mounted to a shaft 120 rotatably mounted between lower frame members 30. A smaller diameter lift pulley 124*a* is connected to shaft 120 on the inside surface of large timing pulley 118, and a timing belt 122 is trained around inside-mounted pulley 124*a* and around a second lift pulley 124*b*. Pulley 124*b* is keyed to a shaft 126, which is rotatably mounted to lower frame members 30. With this arrangement, the pair of lift pulleys 124*a* and 124*b* are rotatable in response to operation of servo motor 110.

A pair of lift arms 128*a* and 128*b* are mounted to lift pulleys 124*a* and 124*b*. Lift arms 128*a* and 128*b* are fixed at their lower ends to shafts 120, 126, respectively, and therefore are pivotable with shafts 120, 126 in response to operation of lift servo motor 110.

Figure 5:
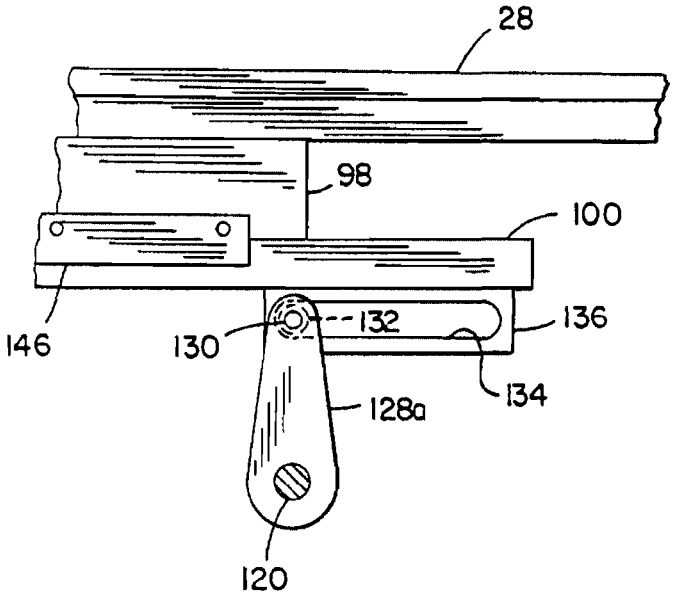
FIG. 5 PRIOR ART

As shown in FIG. 5, lift arm 128*a* is provided with an inwardly extending upper shaft 130 to which is mounted a roller member 132. Roller member 132 is mounted within a cam slot 134 formed in a cam member 136 which is connected to the underside of frame assembly 100. With this arrangement, upon reciprocating clockwise and counterclockwise movement of shaft 120 resulting from reciprocating operation of lift servo motor 110, roller member 130 is caused to move back and forth in cam slot 134 to raise and lower frame assembly 100, to which forming box 98 is mounted. Referring to FIG. 2, a cam member 138 is mounted to the rear portion of frame assembly 100, and includes a cam slot similar to slot 134 formed in forward cam member 136. Rear lifting arm 128*b* is provided with a roller arrangement similar to that described with respect to arm 128*a*. Timing belt 122 trained around lift pulleys 124 provides simultaneous lifting and lowering of lift arms 128*a* and 128*b* to raise and lower frame assembly 100. To ensure that lift arms 128*a* and 128*b* remain parallel to each other, a mechanical link (not shown) is connected between arms 128*a* and 128*b*.

In a preferred arrangement, a pair of forward cam members are mounted one on either side of the forward portion of frame 100, and a pair of forward lift arms 128*a* are connected to shaft 120. Similarly, a pair of cam members 138 are mounted one on either side of the rear portion of frame 100, and a pair of lift arms 128*b* are mounted to shaft 126.

As shown in FIG. 2, a plastic bearing block 140 is mounted to the side of frame assembly 100, and a similar pair block is mounted to the opposite side of frame assembly 100. Bearing block 140 entraps the sides of a vertical shaft mounted to the inside of vertical frame member 144, and a similar arrangement is provided on a vertical frame member on the other side of machine 10. The bearing blocks, such as 140, provide vertical tracking of frame assembly 100 during lifting and lowering of lift arms 128*a*, 128*b*.

Referring to FIG. 5, forming box 98 is mounted to frame assembly 100 by means of a pair of side plates located on either side of forming box 98, with one of the side plates being shown at 146. By loosening the side plates, forming box 98 can be moved to varying positions along the length of frame assembly 100, and thereafter fixed in a desired position by retightening the side plates. This provides accurate positioning of forming box 98 on frame assembly 100. In addition, forming box 98 can be completely removed from frame assembly 100 and replaced with a different forming box providing a different configuration to the product cavity, to accommodate variations in the type of product being packaged. The mounting arrangement as shown and described may be replaced with any other satisfactory arrangement which provides adjustment and removal of forming box 98 relative to frame assembly 100.

As shown in FIG. 2, a vacuum junction 148 is mounted to the frame of machine 10 for transferring negative air pressure from a vacuum tube 150 to the interior of forming box 98 through vacuum line 104 (not shown in FIG. 2), in accordance with known principles.

FIG. 2 generally illustrates the location of plug assist mechanism 108 at forming station 18. FIG. 6 illustrates plug assist mechanism 108 in greater detail. The arrangement of plug assist mechanism 108 shown in FIG. 6 is employed when forming a relatively deep product cavity in lower web 14, in contrast to the arrangement shown in FIG. 4. Referring to FIG. 6, plug assist mechanism 108 includes a frame assembly consisting of front and rear frame members, one of which is shown at 152. A pair of side plate members 154, 156 extend between the front and rear frame members. A pair of lugs 158, 160 are mounted to side frame members 154, 156, respectively.

A pair of linear actuator assemblies 162, 164 are provided one on either side of the frame of machine 10 and are mounted to the structural members of the frame. Actuator assembly 162 includes a linearly movable output member 166 which is vertically movable relative to an actuator body 168. A servo motor 170 is mounted to actuator body 168, for providing rotary input power to actuator body 168 and to provide selective up-down movement of output member 166. Output member 166 is connected to plug assist frame lug 158.

Linear actuator assembly 164 is similarly constructed, providing a vertically movable output member 172, a linear actuator body 174 and a servo motor 176. Output member 172 is connected to frame lug 160.

Linear actuator assemblies 162, 164 are preferably those such as manufactured under U.S. Pat. No. 4,137,784.

With the described arrangement, operation of servo motors 170, 176 results in rotary input power being provided to linear actuator bodies 168, 174, to provide vertical movement of linear actuator output members 166, 172, and thereby lifting and lower of the plug assist frame assembly relative to the frame of packaging machine 10.

An upper plate 178 extends between the front and rear frame members of the plug assist assembly. In the illustrated embodiment, forming box 98 provides a pair of internal cavities to form lower web 14 so as to provide a pair of side-by-side product cavities. A pair of plug assist members, shown generally at 180, 182, are mounted to the underside of upper plate 178 for assisting lower web 14 in conforming to the contour of the internal cavities provided by forming box 98. Plug assist member 180 includes a vertical post 184 and a lower forming member 186 connected to the lower end of post 184. Similarly, plug assist member 182 includes a vertical post 188 connected to the underside of upper plate 178, and a forming member 190 mounted to the lower end of post 188.

Forming members 186, 190 are dimensioned so as to fit within the internal cavity provided in forming box 98 with which each is aligned. Preferably, each edge of forming members 186, 190 is located approximately ½ inch inwardly from the side wall of the cavity to which it is adjacent. Forming members 186, 190 are preferably moved downwardly within the respective forming cavities to a lowermost position in which the bottom of each of forming members 186, 190 is at approximately three quarters of the depth of the cavity.

A pair of vertical guide posts 192, 194 are mounted to the frame of packaging machine 10. Post 192 is received within an opening 193 defined by structure extending between the front and rear frame members of plug assist assembly 108, with the opening having a cross section corresponding to and slightly larger than the cross section of post 192. Similarly, post 194 is received within an opening 195 defined by structure extending between the front and rear frame members of plug assist assembly 108, with the opening providing a cross section corresponding to and slightly larger than the cross section of post 194. With this arrangement, posts 192 and 194 ensure vertical movement of plug assist assembly 108 during operation of linear actuator assemblies 162, 164 in response to operation of servo motors 170, 176. It is understood that any other satisfactory arrangement could be employed for this purpose, e.g. a mating channel and projection type of system.

Forming members 186, 190 are shown in their lowermost position in solid lines in FIG. 6. Forming member 190 is shown in its raised position in phantom.

In accordance with known principles, forming members 186, 190 engage lower web 14 and move lower web 14 downwardly, to assist it in conforming to the forming cavities of forming box 98.

Referring to FIGS. 1 and 2, after the formed lower web is discharged from forming station 18 where it is deformed to provide side-by-side product cavities, the product, shown at P in FIG. 1, is loaded into the product cavities at loading station 20. Product P may be loaded in any satisfactory manner, such as by hand or by an automated loading system. Product P as illustrated in FIG. 1 comprises hotdogs, but it is understood that product P could be any product which is satisfactorily packaged in the manner disclosed, such as ham, bacon, sliced luncheon meat, cheese, pharmaceuticals, or the like.

After the product cavities are loaded with product P, the formed and loaded lower web is moved to upper web supply station 22.

Upper web supply station 22 (FIG. 2) is arranged similarly to lower web supply station 12, and functions in a similar manner. Upper web supply roll 24 is rotatably supported on a shaft 196 stationarily mounted to a bracket assembly 198. A pair of vertical frame members 200, 202 extend upwardly from upper frame members 28 of packaging machine 10, for supporting upper web supply station 22.

An unwinding drive assembly, shown generally at 204, is mounted to the frame of upper web supply station 22 for unwinding upper web material from supply roll 24. The components of unwind drive assembly 204 are the same as those described previously with respect to lower web supply station 12, and function in the same manner as such components. Upper web supply station 22 further includes a dancer assembly 206 which functions in the same manner as the dancer assembly located at lower web supply station 12, for providing selective unwinding of upper web material from supply roll 24 by unwind drive assembly 204 in response to indexing movement of the upper web along with the formed and loaded lower web.

At downstream station 26, a vacuum box 208 is mounted to a frame 210, and is operable in accordance with known vacuum packaging principles to evacuate the product cavities while the upper and lower webs are sealed together, to provide a vacuum package of product P. A heating assembly 212 is located at downstream station 26 to activate sealant on the upper web and lower web 14.

Frame 210 is movable between a raised and lowered position in the same manner as frame assembly 100 located at forming station 18. A lift servo motor 214 is provided for imparting selective lifting and lowering of a pair of lift arms, one of which is shown at 216, through a timing belt and pulley arrangement similar to that described previously at forming station 18.

After the product cavities are evacuated and the upper and lower webs are bonded together to provide a vacuum package for product P, the bonded upper and lower webs are advanced to a cutting station, shown generally in FIG. 2 at 218. As the webs exit cutting station 218, a centrally located cutting blade severs the webs longitudinally to separate the two lanes of formed packages. Prior thereto, a cross-cut mechanism, shown in FIG. 7 generally at 220, then severs the webs transversely.

Cross-cut mechanism 220 includes a frame assembly including an upper frame member 222 and a bracket member 224, which is pivotably mounted to a support member 226 mounted to upper frame member 28 of packaging machine 10. A bracket member 228 is located at the other end of upper frame member 222, and is connected to the extendable and retractable output member 230 of a cylinder assembly shown generally at 232. A bracket 234 connects the lower end of cylinder assembly 232 to a support member 236, which is interconnected with frame member 28 of packaging machine 10.

Cylinder assembly 232 may be any satisfactory assembly for raising and lowering output member 230, such as a pneumatic or hydraulic cylinder, or a solenoid-type arrangement. With this construction, upper frame member 222 is movable between a lowered position as shown in FIG. 7, and a raised position.

A rodless pneumatic cylinder 238 is mounted to the underside of upper frame member 222, and a carriage 240 is connected to the movable output member of rodless cylinder 238. A pair of blade holder assemblies 242, 244 are mounted to the ends of carriage 240, and retain a pair of knife blades 246, 248.

Operation of rodless cylinder 238 provides a cutting stroke to carriage 240 for drawing blades 246, 248 rightwardly through the upper and lower webs, to transversely sever the webs. The output member of rodless cylinder 238 is first moved to its leftwardmost position, so that blade 246 is disposed leftwardly of the leftward edges of the upper and lower webs, and blade 248 is located in the area between the two lanes of formed packages. Output member 230 of cylinder assembly 232 is then retracted, so that the points of blades 246, 248 pierce the upper and lower webs. Rodless cylinder 238 is then operated to move carriage 240 rightwardly, and blades 246, 248 cut through the upper and lower webs to completely sever the webs. Upon a full cutting stroke of rodless cylinder 238, blade 246 is moved rightwardly an amount sufficient to sever the webs up to the point where blade 248 initially pierced the webs. Blade 248 is moved completely through the webs to clear the rightward edges of the webs. Output member 230 of cylinder 232 is then extended to raise blades 246, 248 above the webs, and the output member of rodless cylinder 238 is then moved leftwardly to bring the blades back to their original position, whereafter output member 230 is again retracted to bring blades 246, 248 into contact with the webs.

Blades 246, 248 are conventional blades as used in a utility knife or the like, and therefore are relatively inexpensive and are readily available. This reduces an operator's costs, since blades must often be replaced during operation of packaging machine 10.

Blade holder assemblies 242, 244 are constructed so as to provide quick and easy interchangeability of blades 246, 248, thus minimizing downtime of packaging machine 10 for blade replacement.

Referring again to FIG. 1, a control module 250 is mounted to an arm 252, which is pivotably connected to the upper end of the frame of upper web supply station 22. Control module 250 can be moved to varying positions by the operator of machine 10, who normally is positioned at loading station 20.

Control module 250 includes a touch screen 254 for controlling the operation of servo motors 78, 110, 170, 176 and 214. In accordance with known technology, the operation of the servo motors is controlled by programmable controllers, thereby providing very fine control of the position of the servo motor output shafts, and thereby of the packaging machine components driven by the servo motors. This is in marked contrast to prior art indexing-type packaging machines, which typically employ pneumatic cylinders for providing up and down movement of the plug assist members and the forming and evacuating boxes, and a continuously operating motor with a Geneva drive system for providing indexing advancement of the packaging webs. The servo motors are programmed so as to provide smooth and even acceleration and deceleration of the driven components and rapid intermediate movement for moving the components from one position to another. In this manner, the servo motor driven components of packaging machine 10 can be operated at a very high rate of speed, providing a dramatically increased rate of package production over conventional indexing-type machines, as well as an increased rate of production relative to continuous motion-type machines.

Another advantage offered by the use of servo motors in machine 10 is that the operating parameters can be varied by changing the program which controls the operation of the servo motors. The operating parameters are varied by use of the operator interactive touch screen 254. For example, chains 88*a* and 88*b* lengthen slightly over time due to wear of the links. In a conventional indexing-type machine, this problem is addressed by changing the position of the forming box. With the packaging machine of the invention, the operator simply changes the operating parameters to shorten the length of the indexing web repeat, thus minimizing machine down time.

Figure 8:
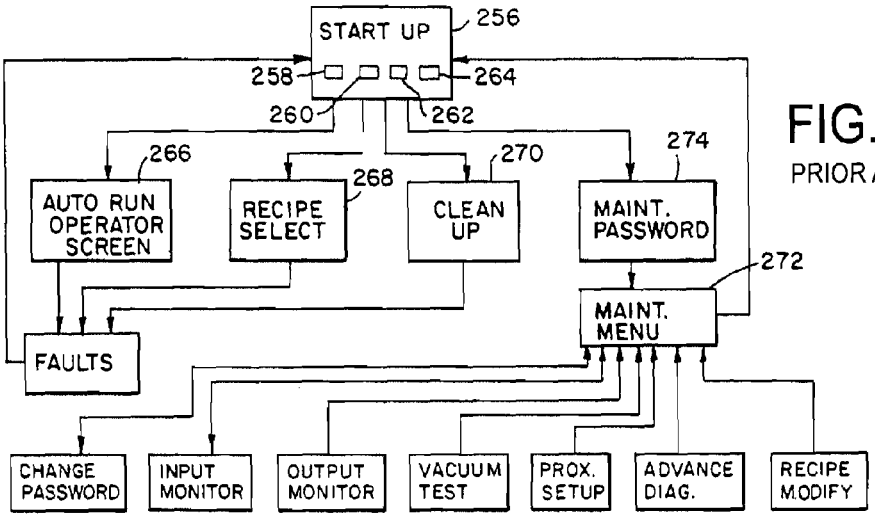
FIG. 8 PRIOR ART

FIG. 8 illustrates the various modes of operation selectable on touch screen 254. On start-up of machine 10, a start-up screen 256 appears, and the operator can touch one of areas 258, 260, 262 or 264 to select one of screens 266, 268, 270 or 272, which respectively comprise an automatic run operator screen, a recipe select screen, a cleanup screen and a maintenance menu screen. Maintenance menu screen 272 can only be selected upon entry of a maintenance password, represented at 274. After the various parameters are set on the appropriate screen, the operator pushes the "start" button associated with a button panel 276 (FIG. 1), to commence operation of machine 10.

Figure 9:
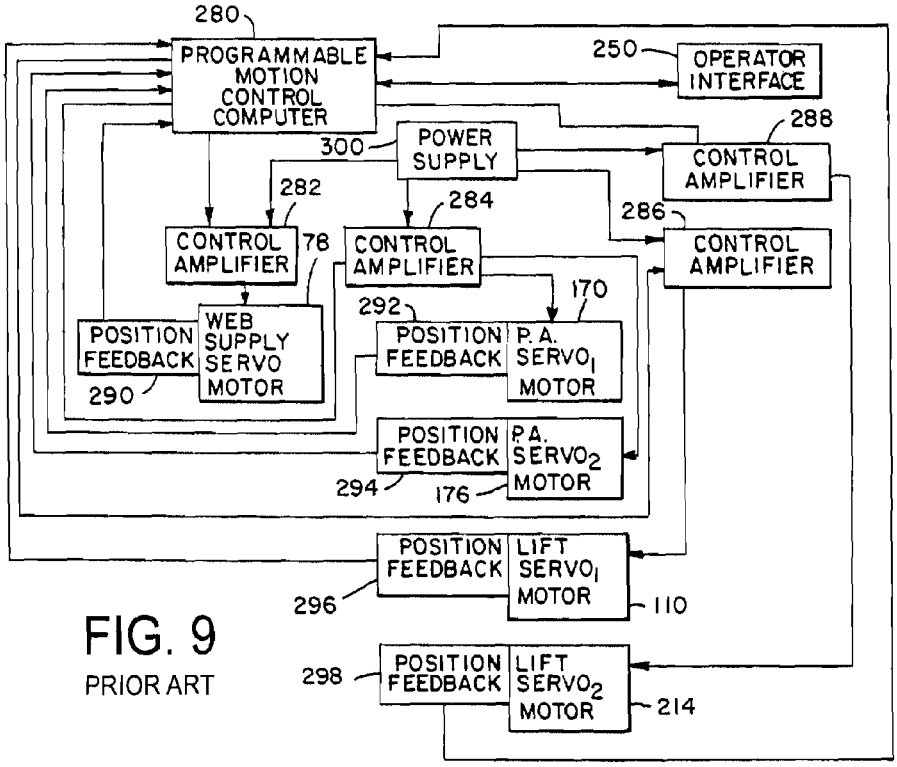
FIG. 9 PRIOR ART

As also shown in FIG. 1, an enclosure 278 contains the componentry which controls the operation of the servo motors associated with packaging machine 10. Referring to FIG. 9, enclosure 278 houses a programmable motion control computer 280, which is interconnected with the operator interface control module 250. Computer 280 provides output signals to control amplifiers, such as shown at 282, 284, 286 and 288. Amplifiers 282, 284, 286 and 288 provide control signals to servo motors 78, 170, 176, 110 and 214, respectively, to control the operation of the motors and therefore the position of the respective motor output shafts. Servo motors 78, 170, 176, 110 and 214 include position sensors and feedbacks 290, 292, 294, 296 and 298, respectively, for conveying to computer 280 the actual positions of the motor output shafts. In this manner, the actual shaft position is compared with the programmed shaft position, and the motor speed is adjusted to move the motor shafts to the appropriate positions.

A power supply 300 provides power for operating the servo motors through control amplifiers 282-288, respectively.

The servo motors are preferably such as manufactured by the Gettys Corporation of Racine, Wis. under catalog number M324-P70A-1001. The motors provide rotary output power to cycloidal type gear reducers, of conventional technology. Suitable reducers are those such as manufactured under the trademark "SM-Cyclo" by Sumitomo Machinery Corporation of America, under Model No. H3105HS. The control amplifiers employed with the servo motors are preferably such as manufactured by Gould, Inc./Motion Control Division of Racine, Wis. under Model No. A700. The programmable motion control computer 280 may be such as manufactured by Giddings & Lewis Electronics under its Model No. PiC49.

Figure 10:
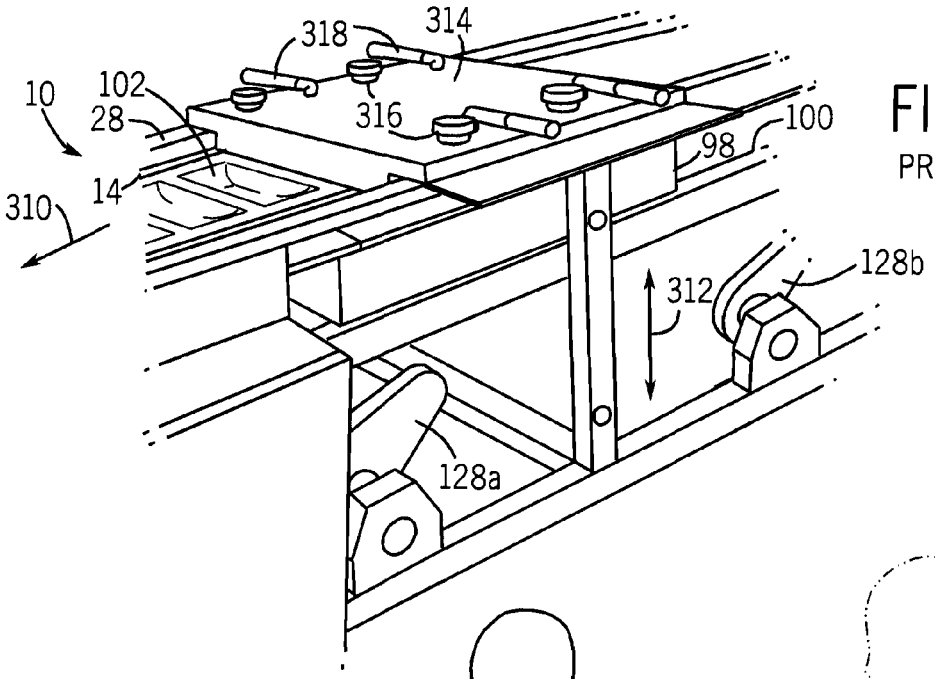
FIG. 10 PRIOR ART

FIG. 10 shows packaging apparatus 10 of FIGS. 1-9 for packaging food product P between the noted upper and lower webs 24 and 14. As above noted, the web transport conveyor provided by chains 88*a*, 88*b* transports lower web 14 from upstream to downstream through a series of stations receiving the product P in the lower web package 102 at loading station 20, FIG. 1, and closing the package with the upper web 24 at closing station 26. Forming station 18 is upstream of loading station 20 and forms downwardly dependent product cavity pocket 102 in lower web 14 into which product P is loaded at downstream loading station 20. Forming station 18 includes the noted forming tooling die box 98 supported on a frame assembly or base plate 100 movable between a first upper position by lift arms 128*a*, 128*b*, in which forming tooling die box 98 engages lower web 14 and forms the lower web into product cavity pocket 102, and a second lowered position in which forming tooling die box 98 is moved downwardly away from lower web 14, to enable advancement of the latter including cavity pocket 102 downstream to loading station 20. Forming tooling die box has a first upper position supported on base plate 100 in the noted first upper position of the latter. Forming tooling die box 98 has a second lower position supported on base plate 100 in the noted second lower position of the latter. Web transport conveyor 88*a*, 88*b* transports lower web 14 from upstream to downstream along a horizontal transport direction 310, FIGS. 10, 1. Base plate 100 moves along a vertical forming direction 312 between the noted upwardly raised first position, and the noted downwardly lowered second position. A cover 314, which may be a plug assist mechanism as shown above at 108 including a plug member 106, or which may omit such plug member, covers lower web 14 at forming station 18 and cooperates with forming tooling die box 98 in the noted first upper position of the latter to provide a vacuum chamber, FIG. 4D, for vacuum-forming lower web 14 into forming tooling die box 98 to form product cavity pocket 102. Cover 314 is stationary and fixedly mounted to frame 28 by threaded knobs such as 316.

Figure 11:
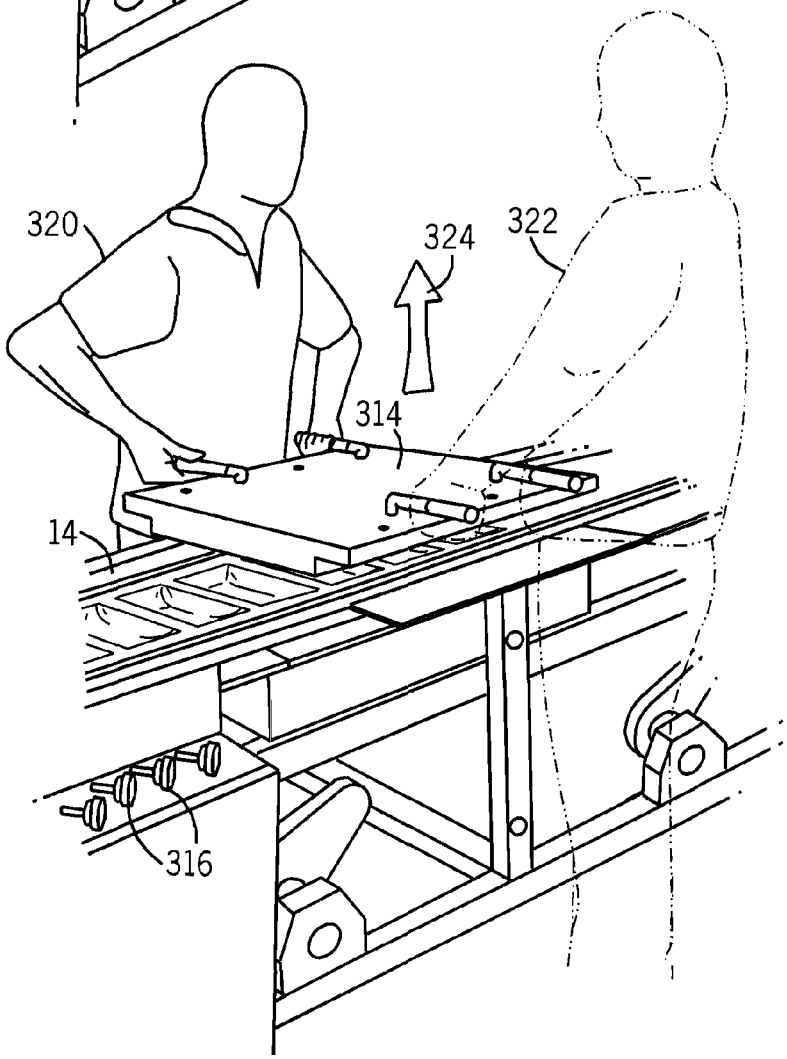
FIG. 11 PRIOR ART
Figure 12:
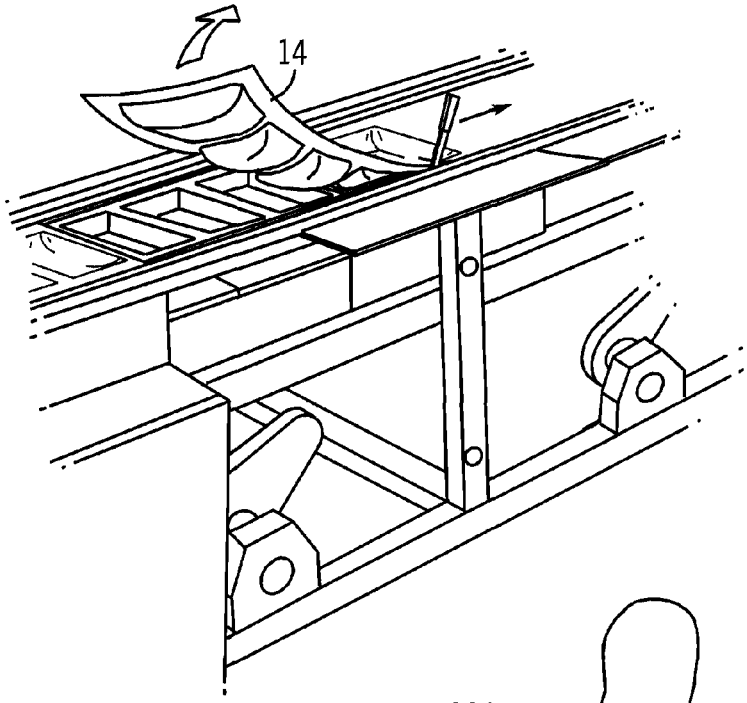
FIG. 12 PRIOR ART
Figure 13:
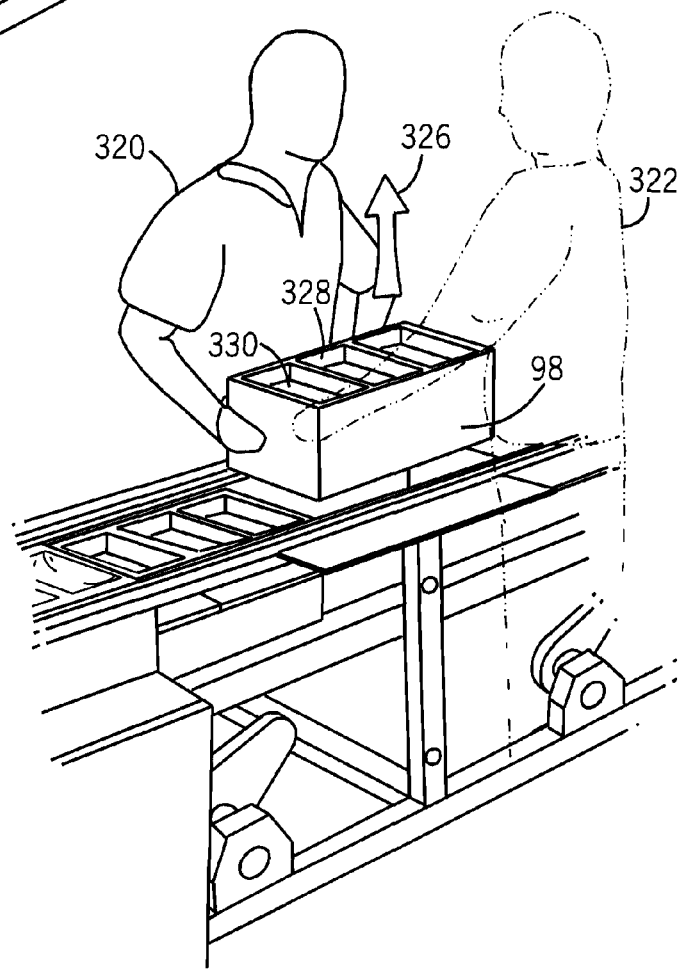
FIG. 13 PRIOR ART

To change tooling, threaded knobs 316 are loosened and removed, followed by lifting of cover 314 at handles 318 by one or more service personnel as shown at 320, 322, FIG. 11. The cover is lifted upwardly as shown at arrow 324. Web 14 is then cut and peeled away, FIG. 12, or the advancement of web 14 from supply station 12 is stopped. This is necessary to enable access to die box 98 from above. The one or more service personnel then lift die box 98 upwardly through the opened gap in web 14, as shown at arrow 326, FIG. 13. Tooling is then changed by re-installing a different die box or providing different shaped inserts such as 328 in the die box or placing insert plates 330 in the die box, and so on, to change the shape, size, etc. of the product cavity pocket 102 to be formed. Objections to the tooling change system illustrated in FIGS. 10-13 include: ergonomically unfriendly, awkward lifting angles and elevated lift height for service personnel to reach over the apparatus and then lift a heavy die box upwardly therethrough and thereabove; for some large heavy tooling, a hoist is necessary to remove it from the apparatus; there is a risk of damage to the noted conveyor chains and chain clips because of the heavy tooling and close proximity during the upward pull; the above factors can limit the size of tooling; film or web material waste due to cutting and peeling away of the film to enable the noted withdrawal of the tooling.

Figure 16:
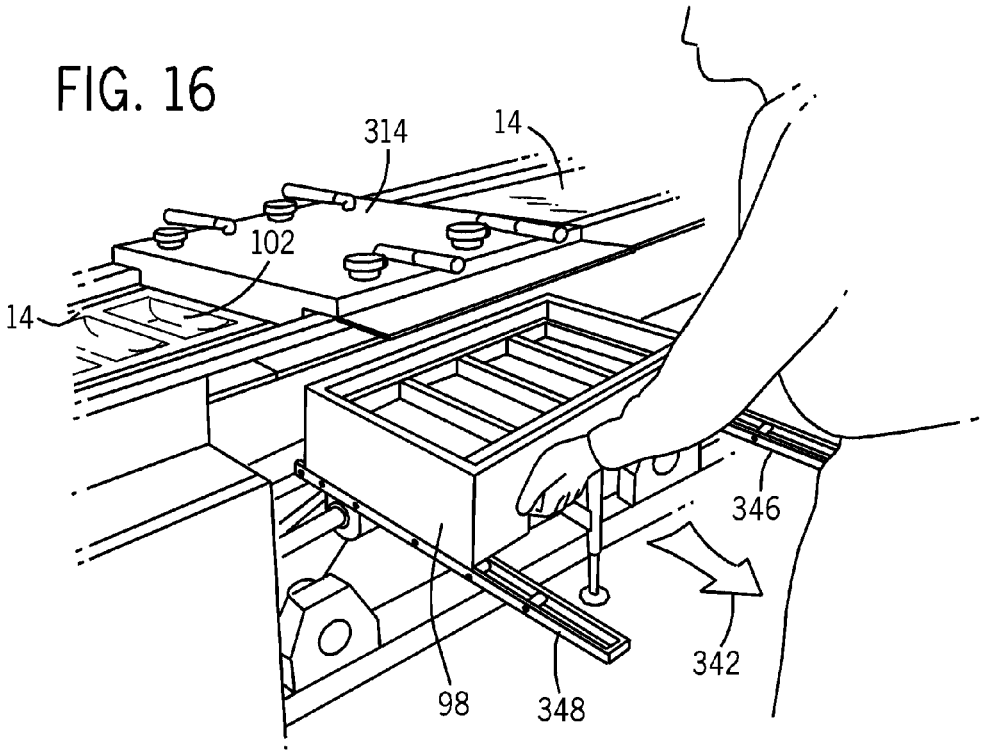
Figure 17:
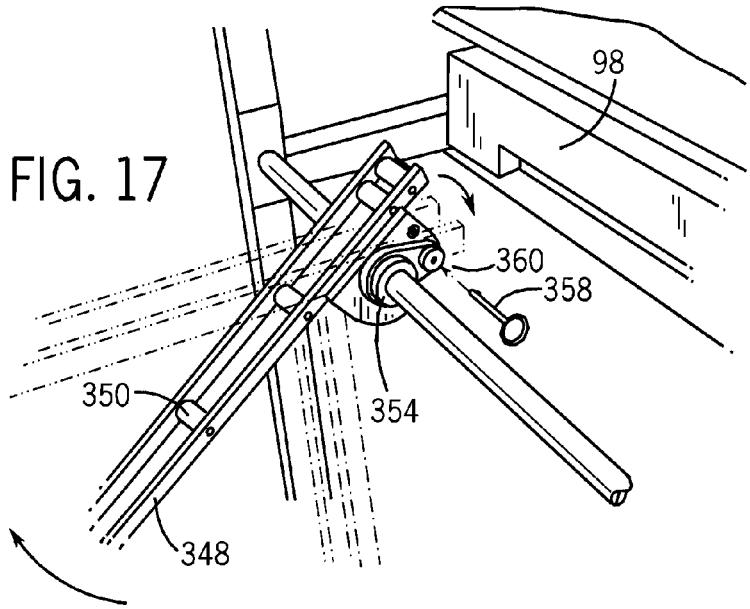

FIGS. 14-17 illustrate the '932 system and use like reference numerals from above where appropriate to facilitate understanding. A third position, FIG. 16, is provided for forming tooling die box 98, namely removed from base plate 100 along a direction 342 different than movement of base plate 100 along vertical direction 312 between the noted first upper and second lower positions. Forming tooling die box 98 is moved to the third position to enable tooling change. Forming tooling die box 98 is moved to the third position along direction 342 transverse to movement 312 of the base plate between the noted first upper and second lower positions. As noted above, web transport conveyor 88*a*, 88*b* transports lower web 14 from upstream to downstream along horizontal transport direction 310. Base plate 100 moves along the noted vertical forming direction 312 between an upwardly raised first position, and a downwardly lowered second position. Forming tooling die box 98 moves along a lateral horizontal side-extraction direction 342 to the noted third position, FIG. 16. Transport direction 310, forming direction 312, and side-extraction direction 342 are orthogonal to each other. Forming tooling die box 98 moves to the noted third position along side-extraction direction 342 with cover 314 and lower web 14 unremoved and in place. Lower web 14 remains uncut and in place during movement of forming tooling die box 98 to the noted third position, FIG. 16, along the side-extraction direction 342.

A guide track assembly 344, FIG. 15, is provided at forming station 18 extending laterally of base plate 100 and supporting forming tooling die box 98, FIG. 16, during movement thereof along side-extraction direction 342 to the noted third position. In one embodiment, the guide track assembly is provided by a pair of laterally extending rails 346 and 348 spaced from each other along transport direction 310. Each rail has a plurality of rollers such as 350 rotatably journaled thereto and laterally spaced therealong and upon which the forming tooling die box 98 rides during movement 342 to the noted third position, FIG. 16. The guide track assembly is movable between a first retracted position, FIG. 14, and a second extended position, FIG. 15. The guide track assembly 344 in the extended position extends laterally of base plate 100 and supports the forming tooling die box 98 during the noted movement thereof along side-extraction direction 342 to the noted third position, FIG. 16. Guide track assembly 344 in the noted retracted position, FIG. 14, is retracted away from the extended position, and permits access to the forming tooling die box 98 in the noted first and second positions thereof at forming station 18. Guide track assembly 344 is pivotable between the noted retracted and extended positions, FIG. 17, at a respective pivot 352 and 354 at each guide rail adjacent base plate 100. In the preferred embodiment, guide track assembly 344 is provided by the noted pair of rails 346 and 348 extending vertically from respective pivots 352 and 354 in the retracted position, FIG. 14, and extending laterally from respective pivots 352 and 354 in the extended position, FIG. 15. Rails 346 and 348 in the extended position extend laterally outwardly from base plate 100 and receive and support the forming tooling die box 98 during movement thereof along side-extraction direction 342 to the noted third position, FIG. 16. Respective locking pins 356 and 358 are insertable along an insertion-locking direction 360, FIG. 17, into the guide track assembly at the respective guide rail to lock the latter in the extended position. Insertion-locking direction 360 is along the noted transport direction 310.

The '932 system provides a method for servicing packaging apparatus packaging a product P between upper and lower webs 24 and 14, and having a web transport conveyor 88*a*, 88*b* transporting the lower web 14 from upstream to downstream through a series of stations receiving the product P in a lower web package 102 at a loading station 20, and closing the package with the upper web 24 at a closing station 26, and including a forming station 18 upstream of the loading station 20, and forming a downwardly depending product cavity pocket 102 in the lower web 14 into which the product P is loaded, the forming station 18 including a forming tooling die box 98 supported on a base plate 100 movable between a first upper position in which the forming tooling die box 98 engages the lower web 14 and forms the lower web into a product cavity pocket 102, and a second lower position in which the forming tooling die box 98 is moved away from the lower web 14, the forming tooling die box 98 having a first upper position supported on base plate 100 in the noted first position of the latter, and the forming tooling die box 98 having a second lower position supported on the base plate 100 in the noted second lower position of the latter. The '932 method includes changing tooling by removing the forming tooling die box 98 from the base plate 100 along a direction 342 different than the noted movement 312 of base plate 100 between its first and second positions. The method includes removing forming tooling die box 98 from base plate 100 along a direction 342 transverse to movement 312 of base plate 100 between the noted first and second positions. The method includes moving the forming tooling die box 98 along transverse direction 342 to a third position, FIG. 16, removed from and laterally adjacent base plate 100. As noted above, the transport direction 310, the forming direction 312, and the side-extraction direction 342 are orthogonal to each other. In the preferred embodiment, the forming tooling die box 98 is removed from base plate 100 by sliding the forming tooling die box 98 laterally along the side-extraction direction 342 along laterally extending guide track assembly 344 to the noted third position, FIG. 16. The method includes moving the guide track assembly 344 between a first retracted position, FIG. 14, and a second extended position, FIG. 15, with the guide track assembly in the extended position extending laterally of base plate 100 and supporting the forming tooling die box 98 during the movement thereof along side-extraction direction 342 to the noted third position, FIG. 16, and the guide track assembly 44 in the retracted position, FIG. 14, being retracted away from the extended position and permitting access to the forming tooling die box 98 in the noted first and second positions thereof at forming station 18. The method includes changing tooling by removing the forming tooling die box 98 from the base plate 100 without removing the cover 314. The method includes changing tooling by removing the forming tooling die box 98 without removing the lower web 14 and without cutting the lower web 14. This provides easier access to the tooling and in a more ergonomically friendly and simplified manner, and without film waste, and without the noted potential damage to the conveyor chains and clips.

As noted above, packaging apparatus 10 may include a cover 314 which may have a plug assist mechanism 108, FIG. 4, including a forming plug or member 106, or which may omit such forming plug. Cover 314 covers lower web 14 at forming station 18 and cooperates with forming tooling die box 98 in the noted first upper position of the latter to provide a vacuum chamber, FIG. 4D, for vacuum-forming lower web 14 into forming tooling die box 98 to form product cavity pocket 102. In covers having a forming plug such as 106, it is typical and known in the prior art to change and replace such forming plug by moving it away from the cover along web transport direction 310.

Figure 19:
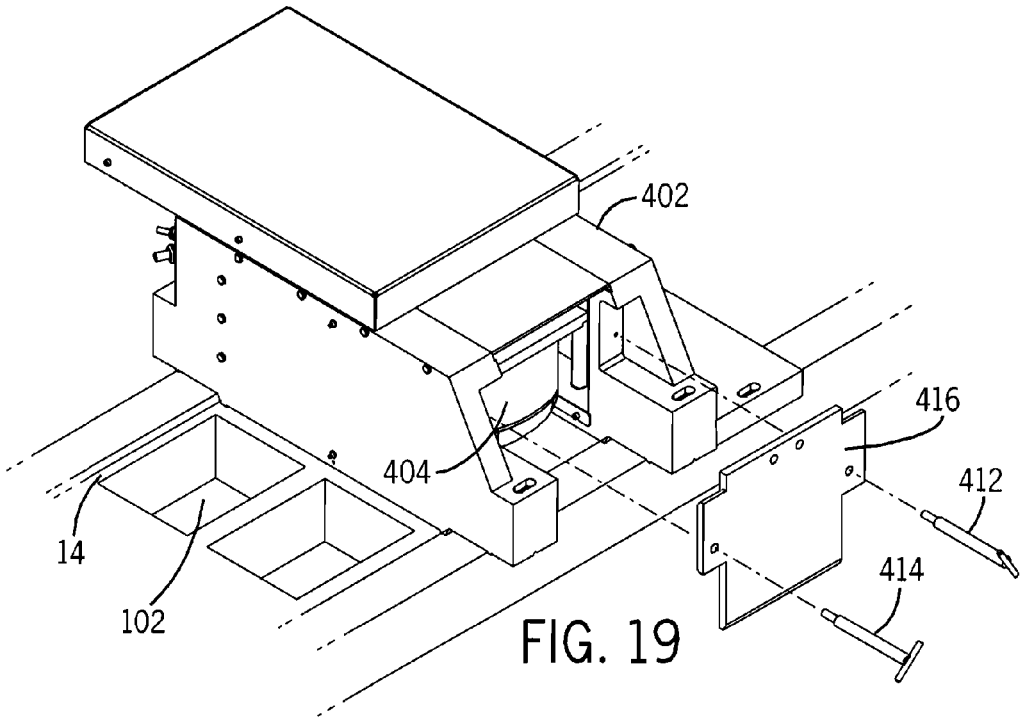
FIG. 19 is like FIG. 18 and illustrates a disassembly condition.
Figure 20:
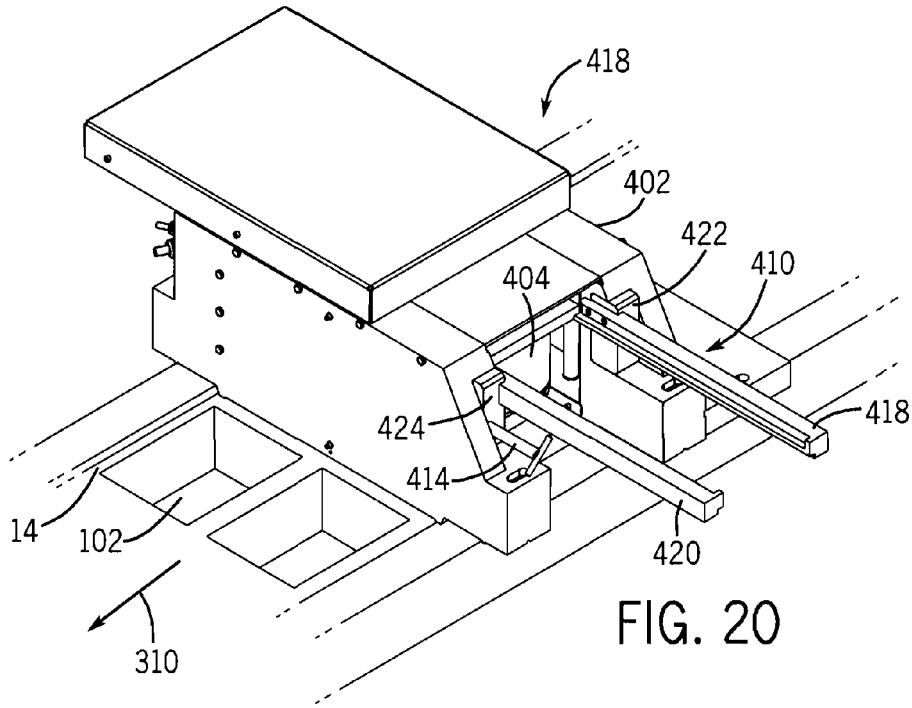
FIG. 20 is like FIG. 19 and illustrates a set-up condition for forming plug removal.
Figure 21:
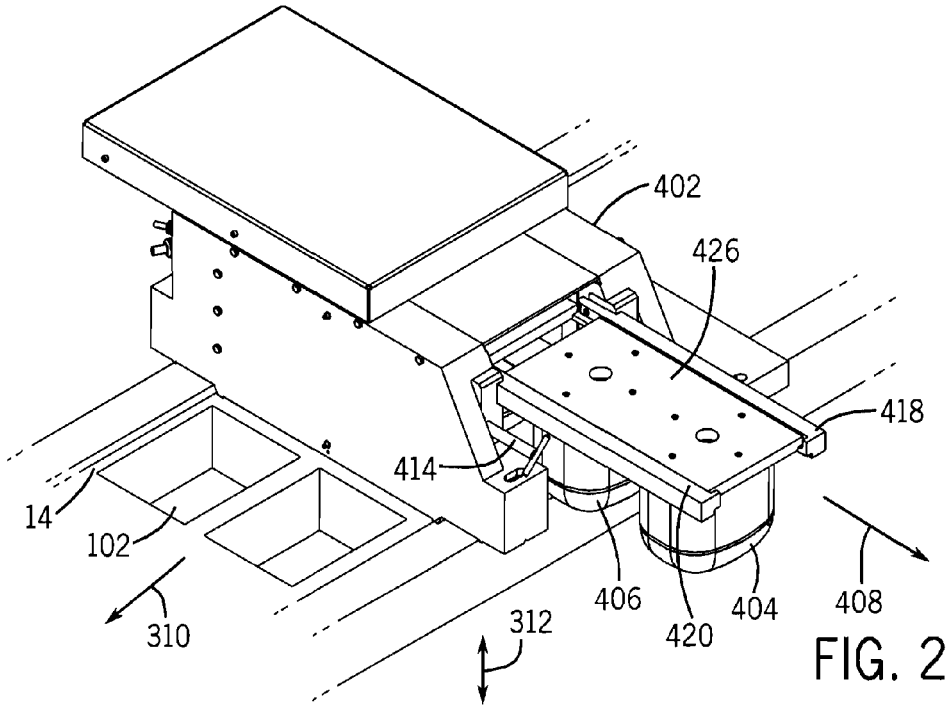
FIG. 21 is like FIG. 20 and illustrates forming plug removal.
Figure 22:
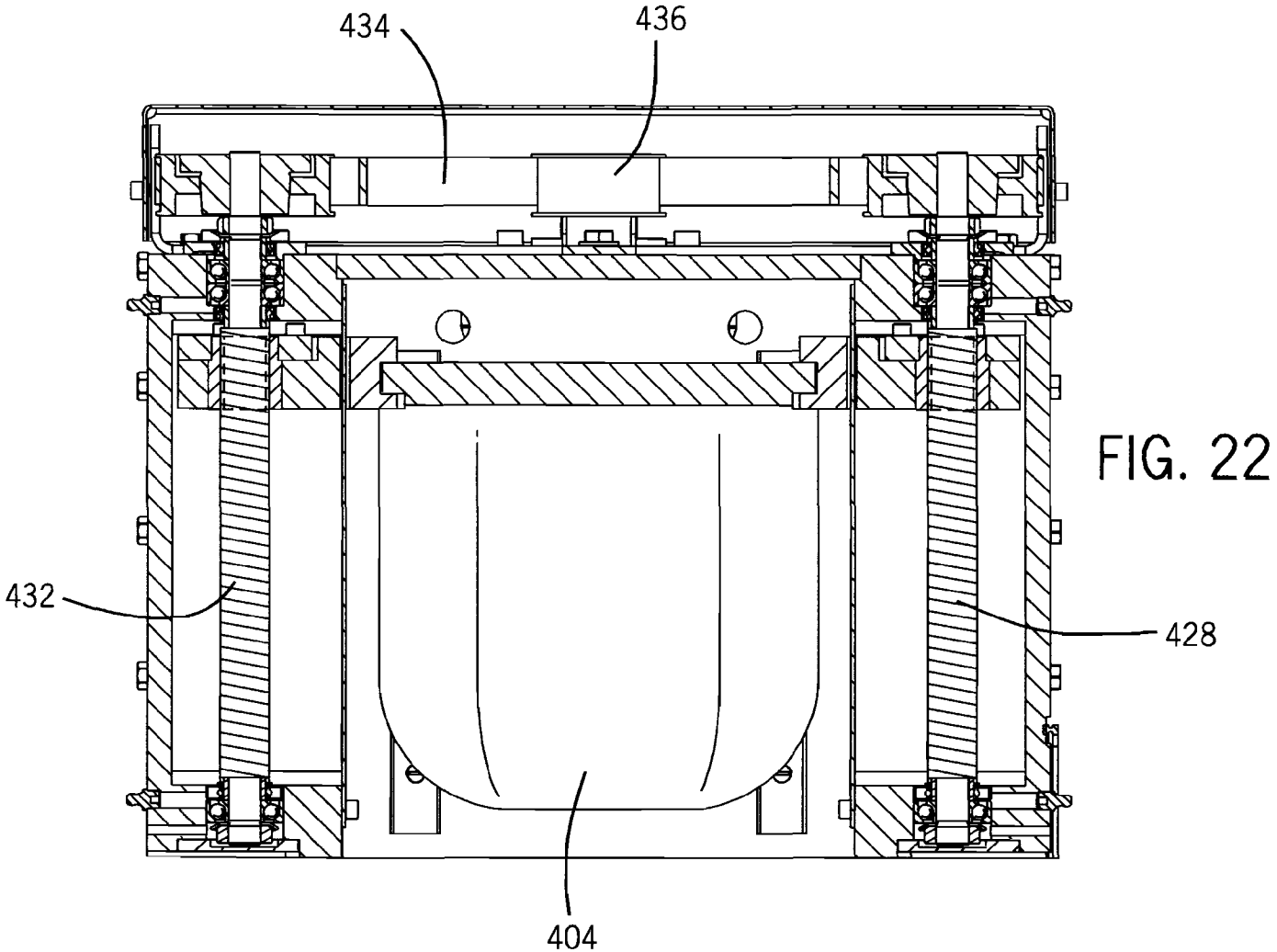
FIG. 22 is a sectional view of the plug assist mechanism of FIG. 18 taken along the web transport direction.
Figure 23:
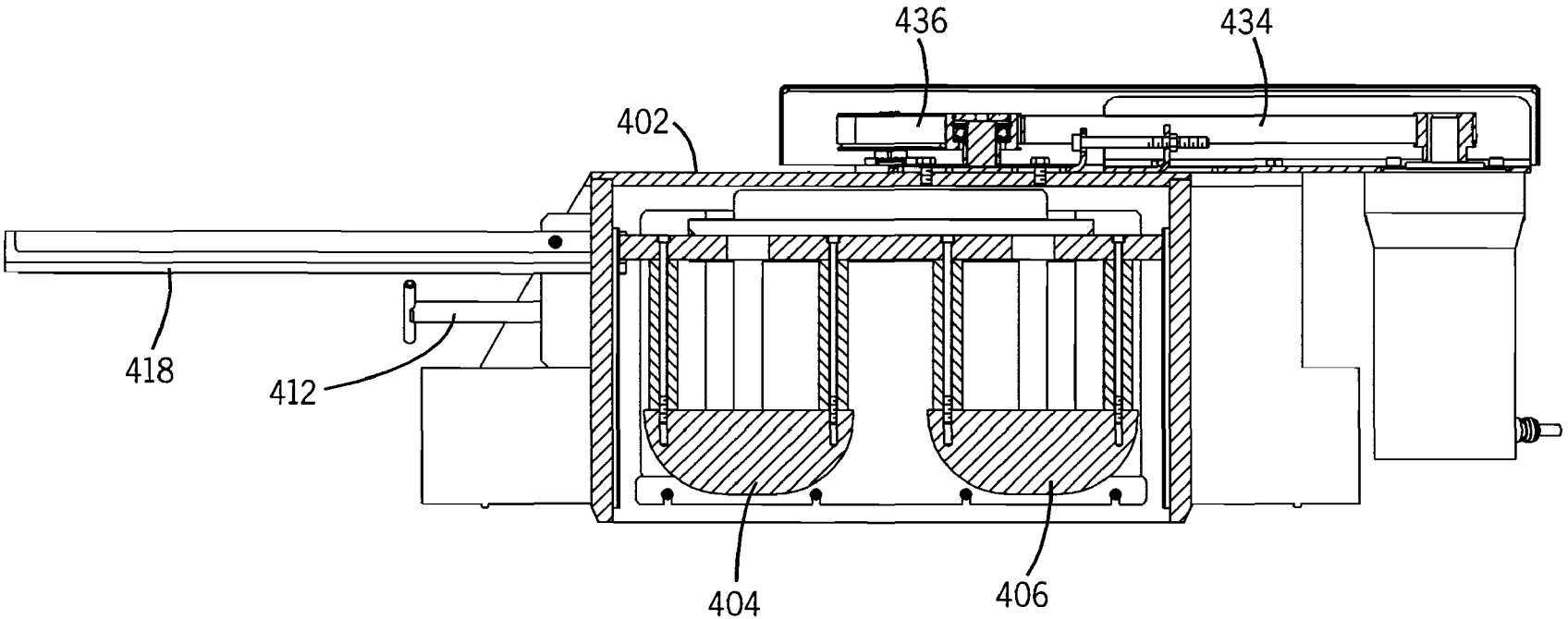
FIG. 23 is a sectional view of the web assist mechanism of FIG. 18 taken transversely to the web transport direction.

FIGS. 18-23 show a plug assist mechanism 400 having a cover 402 supporting one or more forming plugs 404, 406, FIGS. 21, 23. The forming plugs are movable between a first downwardly lowered position in which the forming plugs engage lower web 14 and assist formation of the respective product cavity pocket 102, and a second upwardly raised position in which the forming plugs are moved away from the lower web 14. Forming plugs 404, 406 have a third position, FIG. 21, moved away from cover 402 along a direction 408 different than web transport direction 310. Forming plugs 404, 406 are moved to the noted third position of FIG. 21 to enable replacement thereof. Forming plugs 404, 406 are moved to the noted third position of FIG. 21 along a direction 408 different than web transport direction 310 and different than movement along direction 312 of forming plugs 404, 406 between the noted first downwardly lowered and second upwardly raised positions. Forming plugs 404, 406 are preferably moved to the third position of FIG. 21 along direction 408 transverse to web transport direction 310 and transverse to movement along direction 312 of the forming plugs between the noted first and second positions.

As noted above, the web transport conveyor transports lower web 14 from upstream to downstream along horizontal web transport direction 310. Forming plugs 404, 406 move along a vertical forming direction 312 between a downwardly lowered first position, and an upwardly raised second position. Forming plugs 404, 406 move along a lateral horizontal side-extraction direction 408 to the noted third position of FIG. 21. Web transport direction 310, forming direction 312, and side-extraction direction 408 are orthogonal to each other. Cover 402 is disposed over lower web 14 at forming station 18 and cooperates with forming tooling die box 98 to provide a vacuum chamber for vacuum-forming lower web 14 into the forming tooling die box as assisted by the one or more forming plugs 404, 406 to form the noted product cavity pocket such as 102. The one or more forming plugs 404, 406 move to the noted third position of FIG. 21 along the noted side-extraction direction 408, with cover 402 and lower web 14 unremoved and in-place. The side-extraction along lateral direction 408 is considered a significant advance and improvement over extraction along web transport direction 310 because it eliminates the necessity for service personnel to reach over and above the transport conveyor to access and lift the tooling at ergonomically unfriendly, awkward lifting angles.

Figure 18:
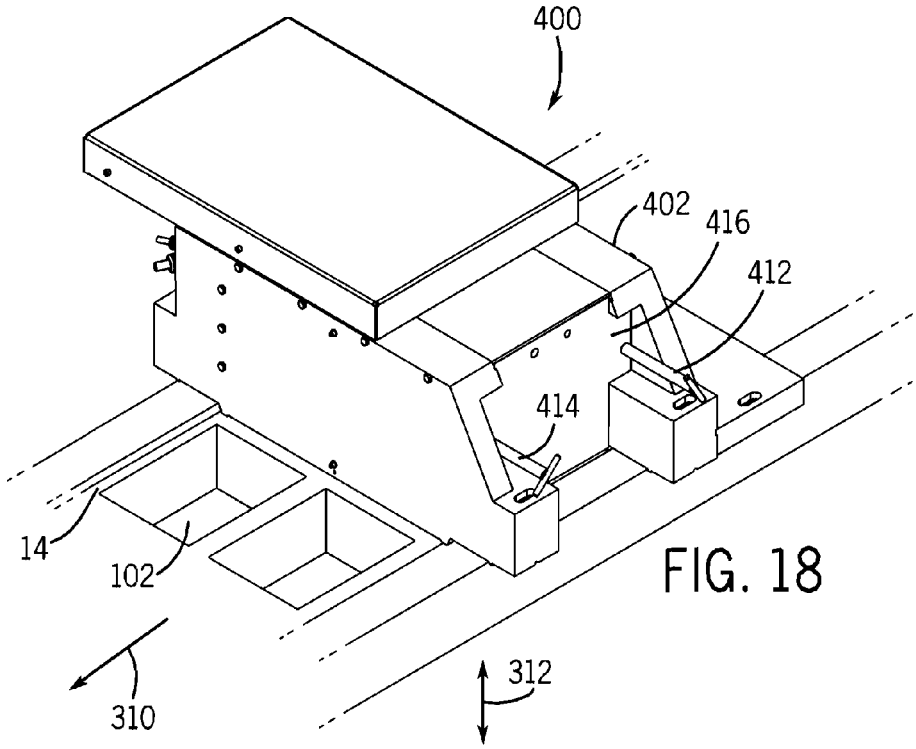
FIG. 18 is an isometric view of the subject matter of the present invention as a component of the apparatus of FIG. 1.

A guide track assembly 410, FIG. 20, is provided at forming station 418 extending laterally of cover 402 and supporting forming plugs 404, 406 during movement thereof along side-extraction direction 408 to the noted third position of FIG. 21. To enable extraction, threaded screw stems 412, 414, FIGS. 18, 19 are removed, followed by removal of plate 416, FIG. 19. The noted guide track assembly 410 is provided by a pair of laterally extending rails 418, 420, FIG. 20, spaced from each other along web transport direction 310. A pair of attachment blocks 422, 424 attach respective rails 418, 420 to cover 402 and enable movement of forming plugs 404, 406 along side-extraction direction 408 to the noted third position of FIG. 21. Bocks 422, 424 are mounted to cover 402 by screw stems 412, 414. Forming plugs 404, 406 are preferably attached to a common mounting plate 426 which is lifted upwardly from rails 418, 420 to remove such forming plugs, followed by replacement with new or different forming plugs. The replacement forming plugs are then re-inserted, leftwardly in FIGS. 20, 21, followed by removal of rails 418, 420 and blocks 422, 424 and replacement of plate 416, secured by screw stems 412, 414. The forming plugs are actuated between the noted first and second positions along forming direction 312 by any suitable mechanism, for example screw drives 428, 430, FIG. 22, driven by a belt and pulley system 434, 436 as known in the prior art, or any other appropriate mechanism.

The present method and system includes moving the one or more forming plugs 404, 406 to the noted third position of FIG. 21 away from cover 402 along a direction 408 different than web transport direction 310. The method further includes replacing the one or more forming plugs 404, 406, including common mounting plate 426 if used, after movement to the noted third position of FIG. 21. Forming plugs 404, 406 are moved to the noted third position of FIG. 21 along direction 408 transverse to movement along direction 312 of the forming plugs between the noted first and second positions and different than web transport direction 310, preferably transverse thereto. The present system provides a method for servicing packaging apparatus packaging a food product between upper and lower webs, the method including changing the one or more forming plugs 404, 406 by removing the forming plugs from the plug assist mechanism 400 along a direction 408 transverse to web transport direction 310 and transverse to movement along direction 312 of the one or more forming plugs 404, 406 between the noted first downwardly lowered position and the noted second upwardly raised position, without removing cover 402.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A method for servicing packaging apparatus packaging a product between upper and lower webs, and having a web transport conveyor transporting said lower web from upstream to downstream along a web transport direction through a series of stations receiving the product in a lower web package at a loading station, and closing the package with the upper web at a closing station, and including a forming station upstream of said loading station, and forming a downwardly depending product cavity pocket in said lower web into which said product is loaded, said forming station including a forming tooling die box, said method comprising providing a plug assist mechanism comprising a cover supporting at least one forming plug movable between a first position in which said forming plug engages said lower web and assists formation of said product cavity pocket, and a second position in which said forming plug is moved away from said lower web, said method further comprising moving said forming plug to a third position away from said cover along a direction different than said web transport direction.

2. The method according to claim 1 comprising replacing said forming plug after said movement to said third position.

3. The method according to claim 1 comprising moving said forming plug to said third position along a direction transverse to movement of said forming plug between said first and second positions.

4. The method according to claim 1 comprising moving said forming plug to said third position along a direction different than said web transport direction and different than said movement of said forming plug between said first and second positions.

5. The method according to claim 4 comprising moving said forming plug along a direction transverse to said web transport direction and transverse to said movement of said forming plug between said first and second positions.

6. The method according to claim 5 comprising moving said forming plug to said third position removed from and laterally adjacent said cover and laterally spaced from said lower web along a direction transverse to said web transport direction.

7. The method according to claim 6 wherein:

said web transport conveyor transports said lower web from upstream to downstream along a horizontal said web transport direction;

said forming plug moves along a vertical forming direction between a downwardly lowered said first position, and an upwardly raised said second position;

said method comprises moving said forming plug along a lateral horizontal side-extraction direction to said third position;

said web transport direction, said forming direction, and said side-extraction direction are orthogonal to each other.

* * * * *